United States Patent [19]

Crain et al.

[11] 4,052,813

[45] Oct. 11, 1977

[54] ANIMATED TOY

[75] Inventors: Philip Warren Crain, Redondo Beach; Otto Leonhard Gabler, Lawndale; Eugene Joseph Kilroy, Jr., Inglewood, all of Calif.

[73] Assignee: Mattel, Inc., Hawthorne, Calif.

[21] Appl. No.: 740,505

[22] Filed: Nov. 10, 1976

[51] Int. Cl.[2] ..... A63H 11/00

[52] U.S. Cl. ..... 46/119; 46/136; 46/147

[58] Field of Search ..... 46/68, 119, 120, 121, 46/128, 129, 104, 136, 137, 138, 147, 207

[56] References Cited

U.S. PATENT DOCUMENTS

| | | | |
|---|---|---|---|
| 1,323,669 | 12/1919 | Allstatter | 46/138 |
| 1,918,122 | 7/1933 | Naue | 46/119 |
| 2,881,559 | 4/1959 | Glass | 46/119 |
| 3,348,334 | 10/1967 | Reynolds | 46/138 |

*Primary Examiner*—Louis G. Mancene
*Assistant Examiner*—Robert P. Swiatek
*Attorney, Agent, or Firm*—John M. May; Robert W. Mulcahy; Max E. Shirk

[57] ABSTRACT

An animated toy figurine includes a simulated head and torso portion and the latter portion contains arms which carry a simulated broom. A hollow support member extends through the interior of the torso portion. The head is mounted to one end of the support member and the torso is rotatably mounted to the support member beneath the head. A plunger is carried within the support member for reciprocative movement therein. Mechanism is included which, responsive to reciprocative movement of the plunger, revolves the torso about the axis of the support member, clockwise and then counterclockwise, a predetermined arcuate extent, whereby the broom is moved simulating a sweeping action.

9 Claims, 6 Drawing Figures

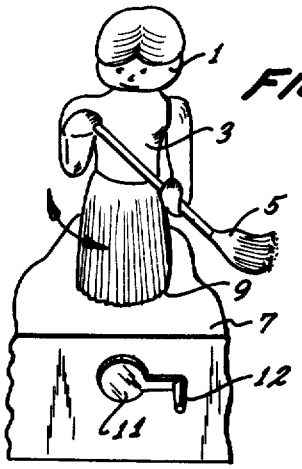
FIG. 1
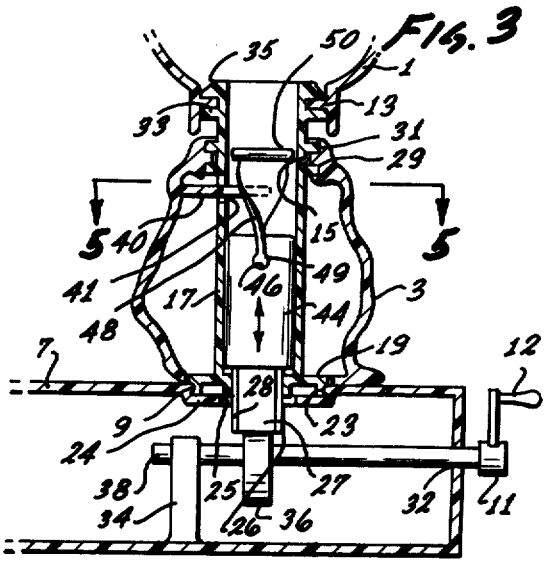
FIG. 3
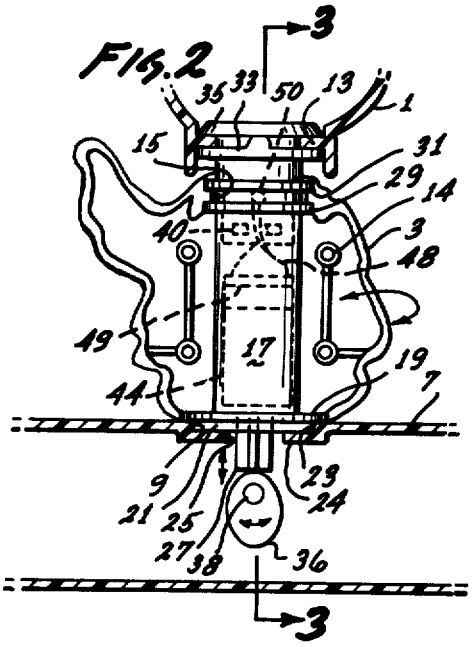
FIG. 2
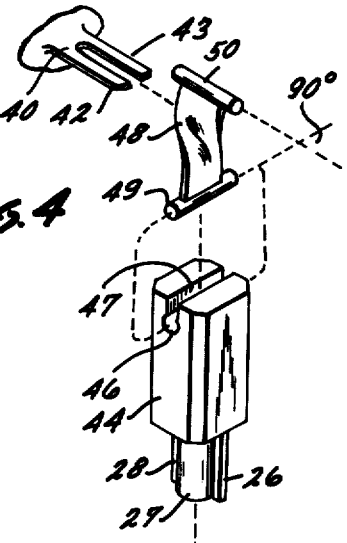
FIG. 4
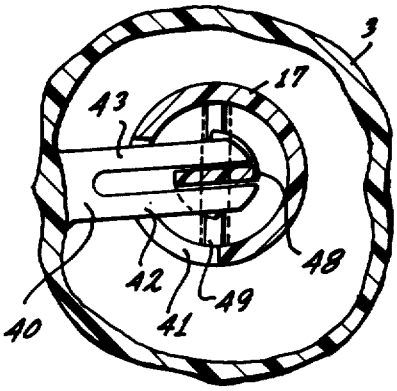
FIG. 5
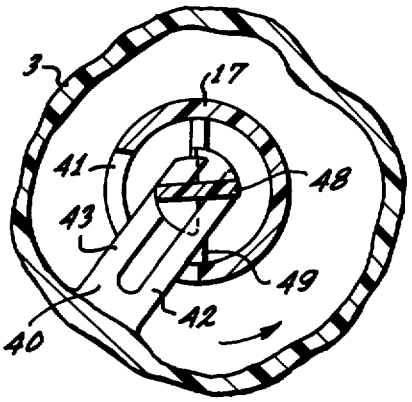
FIG. 6
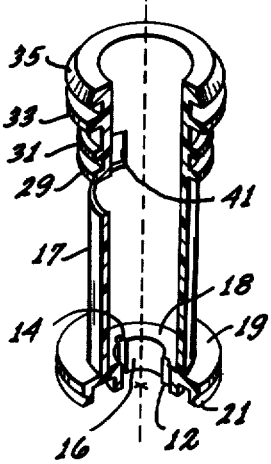

ANIMATED TOY

BACKGROUND OF THE INVENTION

The present invention relates to animated toy figurines, more particularly, to articulated toy figurines in which a simulated appendage is moved to simulate some common human act. Animated toy figurines of the type in which an arm or other appendage are moved by means of a reciprocative plunger actuating means or other mechanism in order to perform some common act are now generally known. More particularly, animated toys of the type containing a plunger-operated mechanism extending from the figurine's base or pedestal whereby a portion of the figurine may be held in hand and bounced or hopped along a surface to effect the plunger reciprocation have been manufactured by the assignee of the present invention, Mattel, Inc., Hawthorne, California. Moreover, the Mattel prior art figurine referred to may be mounted on a base in which the plunger associated with the figurine is received within an opening to engage an eccentric and a hand-operated crank and eccentric combination in which rotation of the eccentric reciprocates the engaged plunger. This permits animation of the figurine by remote operation of the hand crank as an alternative.

The present invention is directly related to the aforedescribed types of toy figurines, and, more particularly, a toy of the aforedescribed type capable of simulating the act of sweeping. It is thus an object of the present invention to provide a toy figurine carrying a simulated broom which can be animated manually by holding a head portion and hopping same along a surface or, alternatively, animated remotely through operation of a hand crank to permit the toy figurine to simulate a sweeping action. A further object of the invention is to provide a novel and inexpensive structure for accomplishing the conversion of a reciprocative motion to a rotary motion, particularly for the purpose of rotating the torso portion of a toy figurine which carries a broom and simulates the act of sweeping.

SUMMARY OF THE INVENTION

In accordance with the foregoing objects, the invention is characterized by a toy figurine having a hollow torso portion, a head portion, a hollow support member which at one end is connected to and carries the head portion and extends through and rotatably supports the torso portion under the head and at its other end contains a pedestal or base. A plunger means is carried by the support member partially extensible from said base for reciprocative movement, and means are provided for converting the reciprocative movement of the plunger along an axis to a rotating movement of the torso about the axis. The torso portion of the figurine suitably carries a broom and the rotational movement, clockwise and counterclockwise, produces a sweeping action. In a specific aspect of the invention the plunger carries endwise an elongated, relatively rigid, axially twisted weblike member. The web is formed into the geometry of a twist about the axis of the plunger of approximately 90°. The torso carries a radially inwardly directed forklike member within the hollow thereof. The forklike member extends through an arcuate slot in the support member and its prongs hug and fit about the twisted weblike member. Axial movement of the plunger in one direction effectively moves the web edgewise along the axis which forces the forklike member and hence the attached torso to rotate in one direction about the axis of the plunger. Movement of the plunger in the reverse direction in like manner moves the torso back to its former position.

The foregoing and other objects and advantages of the invention as well as the structure characteristic of the invention and equivalents thereto are more apparent from a consideration of the detailed description of a preferred embodiment which follows, taken together with the figures of the drawings.

BRIEF DESCRIPTION OF DRAWINGS

FIG. 1 is a perspective illustration of an animated toy figurine of the invention to reduced scale situated in a base, partially illustrated, within which the figurine may be received and remotely actuated;

FIG. 2 is a partial section of the invention illustrating one view of the essential elements thereof and a partial section of the base;

FIG. 3 is a partial section of the invention taken along the lines 3—3 of FIG. 2;

FIG. 4 is an exploded view of the reciprocative-to-rotary motion converter elements employed in the embodiment of FIGS. 2 and 3;

FIGS. 5 and 6 are partial cross-section views to an enlarged scale taken along the lines 5—5 of FIG. 3 which show two different positions of the certain elements of the invention to illustrate rotary movement.

DESCRIPTION OF THE PREFERRED EMBODIMENTS

Reference is made to FIG. 1 which shows the toy figurine having a simulated head portion 1, a simulated covered torso portion 3, with arms carrying a simulated broom 5. The torso includes a full length dress that extends to the bottom and covers underlying elements. The figurine is seated in a well 9 situated atop a base 7, partially illustrated. A shaft, not illustrated in this figure, is connected to a hub 11 to which a crank arm assembly 12 is attached. As indicated by the arrow, the figurine torso is to move counterclockwise and clockwise and the broom 5 simulates a sweeping action responsive to rotation of the crank 12.

The elements with which such operation is performed are better illustrated in the additional figures drawn to different scale and reference is thus made to FIG. 2. The head 1 is partially illustrated and in section. The head is essentially of a hollow shape, suitably formed from two mating portions of injection molded plastic material, and contains a radially inwardly projecting rim 13 within the neck portion. The torso portion 3 likewise contains a hollow interior and extends to the bottom of the figurine. The torso portion is suitably formed in two mating halves of injection molded plastic material which are attached together by means of sockets and prongs, such as the prongs 14, formed in the plastic injection molding process, as is conventional. A support member 17 of generally hollow cylindrical geometry is located within the interior of the body. The support member 17 includes an enlarged base portion or pedestal 19 at the lowermost end. The pedestal includes a grooved portion 21 with which to engage a peripheral lip 23 integrally formed in base 7 surrounding the well 9 within which the figurine is received. Beneath the lip member, a washerlike support base 24 serves as the well bottom. This contains an opening 25 within which to receive a plunger 27, which extends out from within the interior of support member 17.

At its other end, support member 17 includes a first pair of spaced radially outwardly directed rims 29 and 31 extending about the outer periphery to form an annular groove about the axis of member 17. The torso portion includes a radially inwardly directed rim portion 15 at the upper end, which is engaged within the annular groove. Suitably the fit is such that the torso portion is easily revolved in such formed groove so as to be both supported and rotatably mounted. Additionally, further at the upper end another pair of spaced radially outwardly directed rims 33 and 35 extend from and about the outer surface of support member 17 to form another circumferential channel with which to engage the projecting member 13 of head 1 which attaches the head to the support member.

As is later described more fully, the base with which the figurine is used includes an eccentric 36 which engages plunger 27, that is mounted about a shaft 38. Certain elements contained within the hollow of the support member or which are obstructed in this view are represented in dash lines to show location and these elements are more fully described hereinafter.

Reference is made to FIG. 3 which is a partial section view of the embodiment of FIG. 2 taken along the lines 3—3. For convenience, the description of elements previously described in connection with FIG. 1 need not be fully repeated. As is shown in this figure, the torso 3 includes a projecting forklike member 40 which, suitably, is integrally formed in the inner torso surface. The forklike member contains two prongs, as later becomes apparent, and extends radially inward, orthogonal to the axis of the plunger, to a distance slightly beyond the axis of plunger 27. The fork extends through an arcuate slot 41 in the support member 17. The plunger assembly includes a plunger 27, containing two axially extending protruding flanges 26 and 28, which extends through a small opening in the pedestal 19 of support member 17 and further contains an axially extending enlarged portion 44, which cannot extend through the pedestal opening and, hence, serves as a stop to outward movement of plunger 27.

The enlarged portion 44 of the plunger assembly contains a passage 46 of a keyhole-like cross-section. An elongate axially twisted weblike member 48 of a relatively stiff construction includes a pinlike member 49 attached at one edge received within the cylindrical portion of keyhole slot 46, and a second pinlike member at its other end 50. The web is seen to be of an axially twisted configuration so that the axis of the pins are approximately 90° apart. A prong of fork member 40 is seen to straddle the surface of twisted web 48. Additionally shown in this figure is the shaft support member 34 and an end wall shaft support member 32 in base 7 as well as another view of the shaft 38 and eccentric 36.

Turning now to the exploded view of FIG. 4, the pertinent elements are seen in a more realistic perspective. Thus, fork member 40 consists of two spaced prongs 42 and 43 separated by a small distance. Only a portion of the supporting torso 3 wall is illustrated. The geometry of the twisted weblike member 48 and end pins 49 and 50 are shown. Thus the axis of pin 50 and the axis of pin 49 are at an angle of 90° to one another. The web 48 is of a smooth surfaced plastic material that is essentially rigid so as to provide a guiding surface and be able to exert a force, either clockwise or counterclockwise, upon one or the other of the prongs 42 and 43 which straddle the web. The enlarged element 44 is of a blocklike shape, as is shown, and is made from an essentially rectanguloid plastic part having the axially extending edges chamfered so that the enlarged portion fits within and is easily movable within the internal hollow of cylindrical support member 17 shown below.

The cylindrical passage and connected slot 46 and 47, which formed a keyhole-like opening in the view of element 44 presented in FIG. 3, is more clearly visible in this figure. As is shown, slot 47 is of a width smaller than the diameter of the passage 46 and smaller than the diameter of pin 49. As is shown by the dotted lines, pin 49 is slid into and received within the cylindrical passage 46 while the web portion 48 extends through slot 47 so as to support the web on the plunger assembly.

Plunger 27 includes the two axially extending radially projecting flange portions 26 and 28, as was earlier described. Turning now to the support member 17, the support member, which for purposes of clarity of illustrations has had a quarter section removed, is seen to be of an elongate hollowed out construction within which is received the plunger portion 44. The outer periphery of the support member includes the projecting rims 29 and 31 with which to rotatably mount the torso portion, and the rim portions 33 and 35 with which to support and hold in place the figurine's head. The slot 41 in the side wall of member 17 extends circumferentially around the periphery of the support member 17 over a predetermined angle such as 90°. The height of the slot is suitably great enough to receive fork member 40, previously described.

A restricted wall portion 18 borders the bottom end of support member 17. A smaller diameter opening 16 and a pair of radially directed extending slots 14 and 12 are shown.

Opening 16 is large enough to allow the plunger 27 to extend therethrough but because of the larger size of the element 44 the plunger cannot fall out. Moreover, the projecting flanges 26 and 28 of plunger 27 fit slideably within the slots 12 and 14 to form a key-slot arrangement. Thus the plunger is permitted to move along the axis of support member 17, reciprocally, but is prevented from turning or rotating in the support member. All of the aforedescribed parts are made of suitable plastic material, preferably by injection molding processes. In assembly, the twisted web member 48 is fitted within the end of plunger 27. The plunger assembly, in turn, is dropped into place in the support member. Subsequently the assembly may then be inserted in one half of the torso section containing the fork member which is inserted through slot 41 into engagement with the surfaces of web member 48. The other torso portion, not illustrated, is then joined in place and the entire assembly rotated slightly to ensure that the support is relatively friction free enough to allow rotation. The head member, suitably formed, is snapped into position in the grooves formed by rings 33 and 35. As is illustrated to enlarged scale in the section view of FIG. 5 and FIG. 6, the teeth essentially straddle the surfaces of the twisted web member 48. Relating to the illustrations of FIGS. 2 and 3, the illustration of FIG. 5 corresponds to a position where the plunger 27 is fully extended and the eccentric 36 is at its low point. When the eccentric is rotated, such as by hand crank 12 in shaft 38, to its high point it pushes the plunger 27 upwardly. In so doing, the surface of the web as grasped by the teeth of prong 40 appears to rotate about the axis of the plunger. Thus, for example, in FIG. 6 the surface of web 48 forces fork 40 to revolve in the direction of the arrow. Inasmuch as fork 40 is attached to the torso 3 and the torso 3, as was described, is rotatably mounted to the support member 17, the fork and the torso 3 are rotated counterclockwise about the axis of the plunger. Conversely, as the crank is rotated further back to the position shown in FIG. 2, the plunger due to its inherent weight reciprocates out of the member 17 and the web member 48 appears to rotate back to its original position guiding the tooth 43 in a clockwise direction until the plunger is fully withdrawn to the position shown in FIG. 2.

The arrangement of the fork and the twisted web is seen to provide the means to convert the reciprocal or axial movement of the plunger to an arcuate or revolving movement of the torso 3.

Suitably, the engagement between the rim 23 and the groove in the pedestal base of support member 17 is sufficient to hold the figurine in place during cranking operation.

Additionally, as is shown in FIGS. 2 and 3, the torso is draped downwardly about the pedestal but is not attached to the outer periphery of the support member or to the surface 7 of the base so as to completely clothe the figurine and allow free rotation. Suitably the amount of friction between the projecting member 15 and the support member is less than that caused by the forces due to the gravitational downward pressure upon the plunger when the plunger is released, such as when the cam returns to its low position so that the foregoing action occurs. In other practical embodiments of the foregoing invention, where a greater amount of friction exists or is required in the rotatable mounting of torso portion 3, the outward movement of the plunger, accomplished by gravity in the foregoing, may require the assistance of additional force. Thus, for example, a compression spring may be added within the head or support member and engages the upper pin 50 so that when the plunger is raised to its high position the spring is compressed and when withdrawn the compressive force of expansion assists the plunger in moving downward. As in the case of the prior art devices, a figurine may be withdrawn from the base revealing a toy figurine with an extended plunger. The head of the figurine may be grasped by the child playing with the toy and the figurine hopped along a floor or other surface to alternately insert and then allow withdrawal of the plunger. This in turn allows rotation counterclockwise and then clockwise of the figurine's torso and the resulting sweeping movement of the carried broom.

It is believed that the foregoing description of a preferred embodiment of the invention is sufficient in detail to enable one skilled in the art to make and use same. However, it is expressly understood that the details disclosed for the foregoing purpose are not intended to restrict the invention in any way since various alternatives, substitution of equivalents, modifications and even improvements, all of which incorporate the invention, become apparent to those skilled in the art upon reading this specification. Accordingly, it is expressly requested that the invention be broadly construed within the full spirit and scope of the appended claims.

What is claimed is:

1. An animated toy FIGURE which comprises:

a hollow torso portion having a passage therethrough;

a head portion;

an elongated hollow cylindrical support member extending through said torso portion, said support member having an arcuate slot through a cylindrical wall thereof extending partially about the axis of said support member;

said support member further containing a base portion at its lower end having an opening, said opening being of smaller diameter than said cylindrical portion;

means attaching said head portion to an upper end of said cylindrical member;

means for rotatably supporting said torso portion to said support member for rotation about the axis of said support member;

a protruding web member coupled to an inner surface of said torso portion, said forklike member having two spaced pronglike ends extending radially inwardly;

plunger means, said plunger means having a small diameter elongate first portion extending through said opening in said base member, and an elongate larger second portion received within said cylindrical member; said plunger means adapted for reciprocal movement along the axis of said support member;

a cylindrical passage through said larger plunger portion transverse the axis thereof at a predetermined distance from an end, and a slot transverse the axis extending between the end of said plunger and said cylindrical passage to provide entry into said cylindrical passage and define a keyhole-like cross-section, said slot being narrower than the diameter of said passage;

an elongate web member of relatively stiff material, said web member being formed into a twisted geometry to form a twist about its axis; a first pin attached axially to one edge end of said web and a second pin attached axially to the other edge end of said web, one of said pins being fitted within the passage in the end of said plunger means with said web member extending through said slot, whereby said web is carried by said plunger and extends along the axis of said support member; said forklike member extending through said arcuate slot with the prongs of said forklike member straddling said web in a direction transverse the axis of said web, whereby reciprocal movement of said plunger forces the surface of said striplike member to engage and rotate said forklike member about the axis of said plunger and the carried torso portion similarly rotates.

2. The invention as defined in claim 1 further including means for preventing rotation of said plunger in said cylindrical member.

3. The invention as defined in claim 2 wherein said last named means comprises a radially outwardly projecting axially extending rim on said first plunger portion and a slot adjoining said opening in the base of said support member for receiving said rim.

4. The invention as defined in claim 1 wherein said means for supporting said torso includes an inwardly extending rim of said torso and a circumferential groove formed on the outer wall of said support member to receive said rim in slideable engagement.

5. The invention as defined in claim 1 further comprising: a simulated broom carried by said torso portion.

6. An animated toy which comprises:

a torso portion carrying simulated appendages;

a head portion;

an elongate support member having a base portion, said support member extending axially within a head portion being carried by said support member, said torso portion surrounding and covering substantially the entire length of said support member;

plunger means adapted for axial reciprocative movement within said support member, and linear-to-rotary motion converter means coupled to said plunger and to said torso portion for rotating said torso portion a predetermined arcuate extent clockwise and then counterclockwise, respectively, in response to axial movement of said plunger in one direction or the other, respectively.

7. The invention as defined in claim 6 wherein said linear-to-rotary motion converter means comprises:

an elongate web of stiff material having the geometry of a twist located within said support member and extending along the axis thereof, said web being attached to and carried by said plunger means for axial movement therewith;

an arcuate slot in said support member, said slot extending about a predetermined portion of the periphery of said support member in a plane perpendicular to the axis thereof;

a forklike member having two extending prongs coupled to said torso portion and extending radially inwardly through said slot with the prongs thereon straddling the major side surfaces of said web member.

8. The invention as defined in claim 7 including means for supporting said torso portion for rotational movement about said support means.

9. The invention as defined in claim 7 further comprising: a simulated broom carried by said torso portion.

* * * * *